US006342145B1

(12) United States Patent
Houssian et al.

(10) Patent No.: US 6,342,145 B1
(45) Date of Patent: Jan. 29, 2002

(54) PROCESS FOR MANUFACTURING MULTI-COLORED PICTURE FRAMES

(75) Inventors: Vazgen Houssian, Union City, NJ (US); Ralph Jones, Silver Point; Ron Berhardt, Boxter, both of TN (US); David Wellings Pointon, Rivervale, NJ (US)

(73) Assignee: Nielsen & Bainbridge LLC, Paramus, NJ (US)

( * ) Notice: Subject to any disclaimer, the term of this patent is extended or adjusted under 35 U.S.C. 154(b) by 0 days.

(21) Appl. No.: 09/609,268

(22) Filed: Jun. 30, 2000

Related U.S. Application Data

(60) Provisional application No. 60/143,700, filed on Jul. 14, 1999.

(51) Int. Cl.[7] ..... C25D 11/22

(52) U.S. Cl. ..... 205/122; 205/172; 205/175; 205/206; 205/208; 205/213

(58) Field of Search ..... 205/122, 213, 205/206, 208, 172, 175

(56) References Cited

U.S. PATENT DOCUMENTS

| | | | | |
|---|---|---|---|---|
| 197,738 A | | 12/1877 | Lippe | |
| 480,953 A | | 6/1892 | Mauerhofer | |
| 481,117 A | | 8/1892 | Naegele | |
| 3,031,387 A | | 4/1962 | Deal et al. | 204/58 |
| 3,284,321 A | * | 11/1966 | Fromson | 205/175 |
| 3,408,759 A | | 11/1968 | Rotheraine et al. | |
| 3,720,143 A | | 3/1973 | Hashimoto et al. | |
| 3,789,529 A | | 2/1974 | Thom | 40/158 R |
| 3,833,374 A | | 9/1974 | Patrick | |
| 3,839,163 A | | 10/1974 | Kaneda et al. | |
| 3,841,891 A | | 10/1974 | Pallant | |
| 3,874,949 A | | 4/1975 | Kaneda et al. | |
| 3,935,349 A | | 1/1976 | Terai et al. | 427/409 |
| 4,101,386 A | | 7/1978 | Dotzer et al. | 204/32 R |
| 4,111,762 A | * | 9/1978 | Wade et al. | 205/208 |
| 4,868,232 A | | 9/1989 | Hartridge et al. | 524/35 |
| 4,869,789 A | | 9/1989 | Kurze et al. | 204/56.1 |
| 4,904,349 A | | 2/1990 | Tokushima et al. | 204/27 |
| 5,367,802 A | | 11/1994 | Rosenberg | |
| 5,567,551 A | | 10/1996 | Yahalom et al. | |
| 5,759,742 A | | 6/1998 | West et al. | |
| 5,985,416 A | | 11/1999 | Sherman et al. | 428/195 |

* cited by examiner

*Primary Examiner*—Arun S. Phasge
(74) *Attorney, Agent, or Firm*—Darby & Darby

(57) ABSTRACT

Methods of producing aluminum picture frames having two regions of different colors. Aluminum frame stock is coated with a colored maskant or paint. Selective regions of the coated frame stock are abraded, and then anodized and dyed a second color absorbed by the exposed regions. In a second embodiment, aluminum frame stock is etched, anodized, and dyed a first color. The frame stock is then selectively abraded to remove regions of the first color, and then anodized and dyed a second color so the abraded regions absorb the second color. In a third embodiment, the frame stock is first etched, anodized, and dyed a first color. Selective areas of the frame stock are protected using an etch-resistant mask and is then etched stripping the unmasked regions of the first color and then anodized again and dyed a second color absorbed by the unmasked regions. The mask is then chemically removed.

14 Claims, 3 Drawing Sheets

PROCESS FOR MANUFACTURING MULTI-COLORED PICTURE FRAMES

This patent application claims the priority of U.S. provisional patent application No. 60/143,700, filed on Jul. 14, 1999, which is incorporated herein by reference.

BACKGROUND OF THE INVENTION a) Field of the Invention

This invention generally relates to metal picture frames, and, more particularly, to a method of manufacturing metal picture frames having multiple, anodized, colored regions.

b) Description of the Prior Art

A known and desired practice in the framing art is to mount a picture or painting within a multi-colored frame. Older wooden frames were painted in various colors as desired, using an appropriate mask to create a sharp transition between one colored region and an adjacent region of a different color. The prior art painting process required to introduce two adjacent colors tends to be labor intensive and does not lend itself well to the extruded aluminum frame commonly used today.

Another technique used to provide picture frames with multiple colored regions is called a "picture within a picture" technique and involves the nesting or stacking of two (or more) frames together (i.e., one inside the other) wherein each frame displays a different color or texture. With this technique, an outer frame of a first color receives an assembled second frame having a second color. The second frame is sized to concentrically fit within the first frame. The two frames are typically clamped together from behind so that they appear as a single, multi-colored (two tone) frame assembly when viewed from the front. Such picture within a picture frame assemblies are disclosed in U.S. Pat. Nos. 5,367,802 issued to Rosenberg, U.S. Pat. No. 3,408,759 issued to Rotheraine et al., U.S. Pat. No. 481,117 issued to Naegele, U.S. Pat. No. 480,953 issued to Mauerhofer, and U.S. Pat. No. 197,738 issued to Lippe.

Although these prior art combination frames are aesthetically pleasing, they are difficult and expensive to manufacture, and time consuming to assemble. In particular, with such multi-frame assemblies, it is difficult to cut the corner miter joints of both (or all) frames accurately so that all stacked frames (inner and outer) appear aligned.

A great number of picture frames manufactured today are made from aluminum. Aluminum frames may be colored using any of several techniques including, for example, surface painting, surface covering (applying a colored layer to the frame surface, e.g., a colored adhesive film), and electro-chemical coloring techniques, such as anodizing and subsequent dyeing.

Anodizing processes are cost effective at coloring large quantities of aluminum frame stock during the manufacture of the frame assemblies. The resulting colored finish of an anodized and dyed frame is very thin, uniform, and durable.

The basic reaction in all anodizing processes is the conversion of an aluminum surface to aluminum oxide with the aluminum part serving as the anode of an electrolytic cell. It is well known to use dye baths to uniformly color newly anodized aluminum parts. Once immersed in a dye bath, the aluminum will take on the color of the dye by absorbing the dye colorant into the microporous structure of the newly anodized surface, thereby producing a uniform color throughout the entire exposed aluminum part. Dyes useful in coloring aluminum are also well known and include those disclosed in U.S. Pat. No. 3,264,142, issued to Wainer, which is hereby incorporated by reference.

In the framing industry, aluminum frames are typically colored using an anodizing/dye-immersion method; however, this technique is only suitable for uniform coloring of the aluminum part. The frames may similarly be colored using other coloring techniques, such as painting, using a single color, for example.

It would be beneficial to use anodizing and/or painting techniques to provide an aluminum picture frame that includes two or more regions of different colors.

Accordingly, it is an object of the invention to provide an improved method for making an aluminum picture having at least two different colors.

It is another object of the invention to provide a method for manufacturing such an aluminum picture frame easily and cost effectively.

It is another object of the invention to provide a method for manufacturing a multi-colored picture frame using painting and anodizing techniques having sharp defined boundaries between adjacent colored regions.

It is yet another object of the invention to provide such a multi-colored picture frame which overcomes the deficiencies of the prior art.

SUMMARY OF THE INVENTION

According to a first and preferred embodiment, aluminum frame stock is coated with a colored maskant. Selective regions of the coated frame stock are abraded, thereby exposing bare aluminum in those selective regions. The abraded frame stock is then anodized and dyed a second color so that the exposed regions absorb the second color, adjacent to the colored masked regions. The resulting frame includes first regions having a first color (the maskant) and second regions having a second color.

According to a second embodiment of the invention, aluminum frame stock is etched, anodized, and then dyed a first color. The frame stock having the first color is then abraded to remove selective regions of the first color, thereby exposing the aluminum in these regions. The abraded frame stock is then anodized and dyed a second color so that the abraded regions absorb the second color, resulting in the frame stock having first regions of one color and second regions of a second color. The two-colored frame stock may then be used to form picture frames.

According to a third embodiment of the invention, the aluminum frame stock is first etched, anodized, and dyed a first color. Selective areas of the frame stock are then protected using an etch-resistant mask. The colored, masked frame stock is then etched to strip the unmasked regions of the first color, thereby exposing the aluminum surface in those regions. The frame stock is then anodized again and dyed a second color so that the unmasked regions absorb the second color. The mask is then chemically removed, thereby exposing the underlying first color located adjacent to the second color.

DETAILED DESCRIPTION OF THE INVENTION

Figure 1:
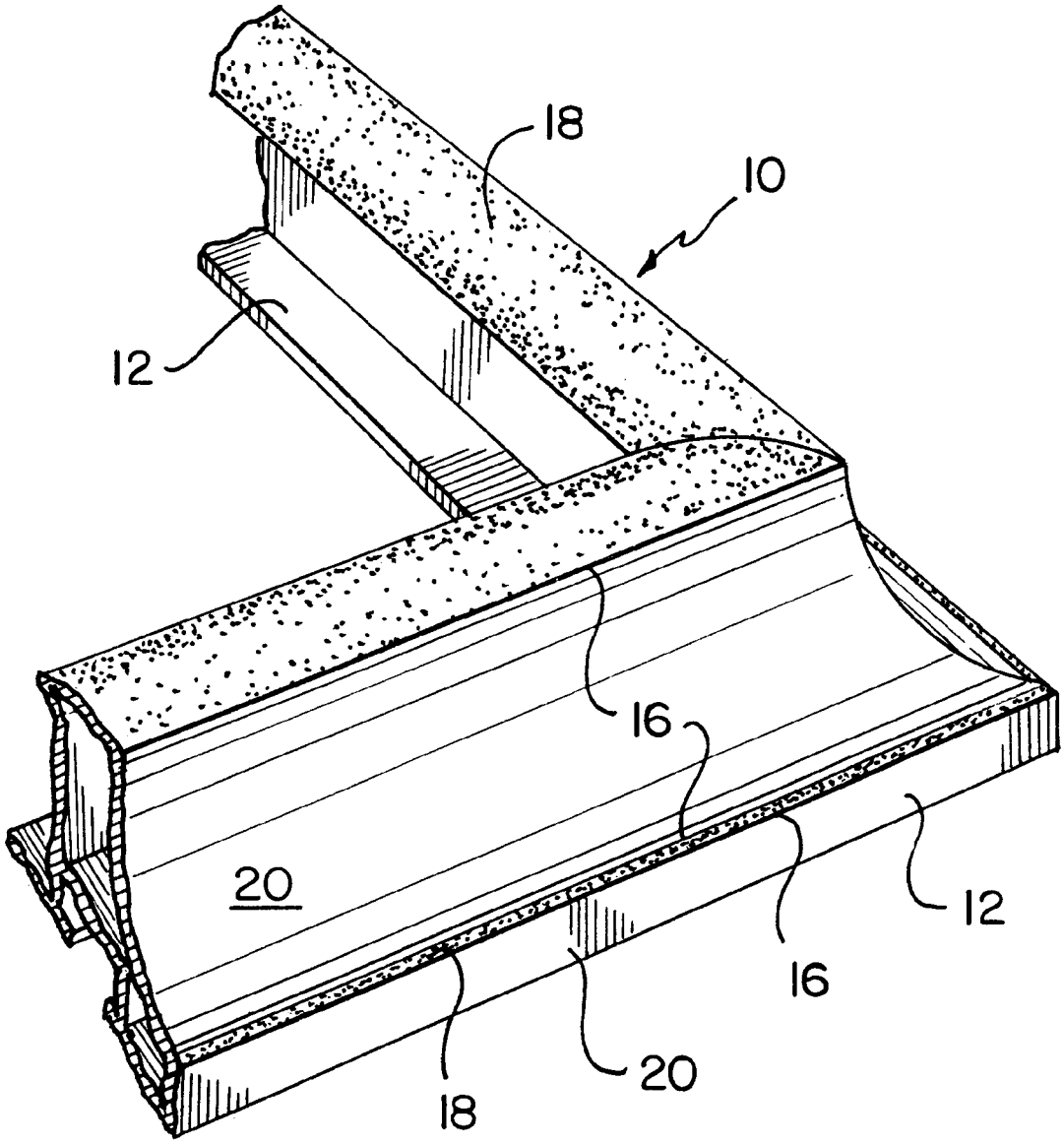
FIG. 1 is a perspective view of a corner section of an extruded aluminum frame assembly showing two regions of different color, produced according to the method of the invention.

According to a first embodiment of the invention, referring to FIG. 1, a picture frame 10 is made up of four elongated frame members 12 (two are partially shown). Each frame member 12 is made from extruded aluminum stock. For clarity, in the following descriptions of the different embodiments of the invention, the extruded aluminum stock that makes up the frame assembly is treated with multi-colored regions, not the picture frame itself. It is to be understood, however, that the described processes of applying multi-colored regions to aluminum may also be applied to cut frame members, and completed frame assemblies. It is generally practical to apply the following coloring techniques to large quantities of extruded frame stock at once, prior to subsequent processes (e.g., cutting, mitering, and frame assembling).

As described above, it is known to color aluminum parts by the steps of cleaning, alkali-etching, anodizing, and dyeing to yield an aluminum part having a uniform color (depending on the color of the dye). Although the type of anodizing process used according to the invention may be conventional and well known to those skilled in the art of anodizing, the different steps of a general anodizing process are described as follows.

Cleaning/Etching

The degree and nature of cleanliness of the aluminum frame parts vary somewhat depending on the type of finishing processes used, the level of acceptable impurities in the final product, and cost. Various cleaning processes may be used alone or in combination as is understood by those skilled in the art. For example, solvent cleaning may be used to remove organic compounds, such as oil and grease contaminants. Emulsifiable solvents, such as kerosine (including emulsifiers and surfactants) are organic solvents that are particularly useful for cleaning aluminum. This type of cleaner is applied to the surface of the aluminum and is also used to remove organic compounds from the aluminum surface. Other cleaning processes suitable for the aluminum frame parts include alkaline cleaning and acid cleaning wherein the layer of oxide, and any other sensitive layers and coatings on the surface of the aluminum parts are removed. Typically, aluminum parts are cleaned using an alkaline solution, usually having a pH between 9 and 11, followed by rinsing in de-ionized water. The anodizing process creates an oxide coating on the surface of the aluminum which contains micropores into which dye colorant is retained if a colored finish is required.

Anodizing

The basic reaction in all anodizing processes is conversion of the aluminum surface to aluminum oxide. This conversion occurs using the aluminum part as the anode of an electrolytic cell.

There are three commonly used anodizing processes: a) chromic, in which the active agent is chromic acid; b) sulfuric, in which the active agent is sulfuric acid; and c) hard processes that use sulfuric acid with specific additives. Except for those produced using hard processes, most anodic coatings range in thickness from 0.002 to 0.007 inches.

Dying

Once anodized, the aluminum is immersed in a bath of dye. The dye colorant is absorbed by capillary action into the micropores of the oxide surface, resulting in the aluminum taking on the color of the particular dye.

Figure 2:
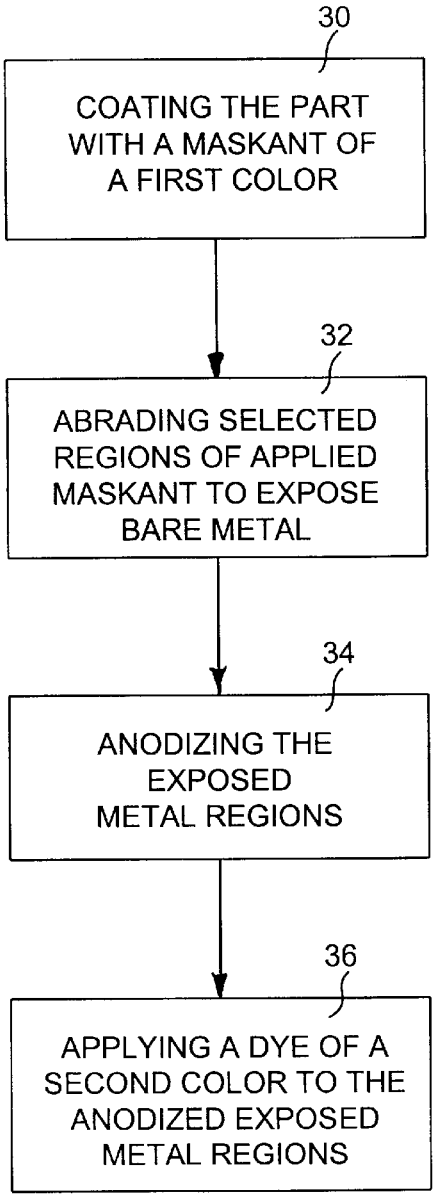
FIG. 2 is a flow chart schematic illustrating a process of creating an aluminum part having two regions of different color, according to a first embodiment of the invention.

According to a first preferred embodiment of the invention, referring to FIG. 2, an aluminum frame stock (or "part) is first painted or coated with a colored maskant at step 30 wherein the color of the maskant is the first desired color of the frame stock. A portion of this maskant will remain on the frame stock and will become part of the finished frame, functioning as a colored paint. This maskant replaces the anodizing step described below in embodiments two and three of the invention.

After the maskant is dry, the frame stock is selectively abraded using at step 32, for example, a grinding machine, as described above. As in earlier steps, the grinder mechanically removes selected regions of the first color maskant, thereby exposing bare aluminum. Careful choice of paint formulation yields very clean, sharp boundary edges to the abraded regions without cracking or chipping. Many different types of commercially available paints can be used as the maskant including cellulose base or polyester base containing pigment colorants. Both opaque and transparent paints may be used, as well as paints that are formulated to dry with either a glossy, semi-gloss, or matte surface finish. One pack and two pack systems may be used according to the final finish and the degree of adhesion required.

Once the selected regions of the first color maskant are mechanically removed, the entire frame stock is anodized (for the first time) at step 34 of FIG. 2, and dyed at step 36, as described above, to produce a second color in the exposed (abraded) regions of the frame stock, adjacent to the first color maskant. The second color dye is absorbed only by the newly anodized surfaces of the exposed (abraded) regions. Careful selection of the maskant (paint composition) prevents any discoloration during the anodizing and dyeing steps. Also, use of an acid and/or alkali resistant maskant (paint) allows the frame stock to be etched prior to anodizing without damage to the first color maskant.

Figure 3:
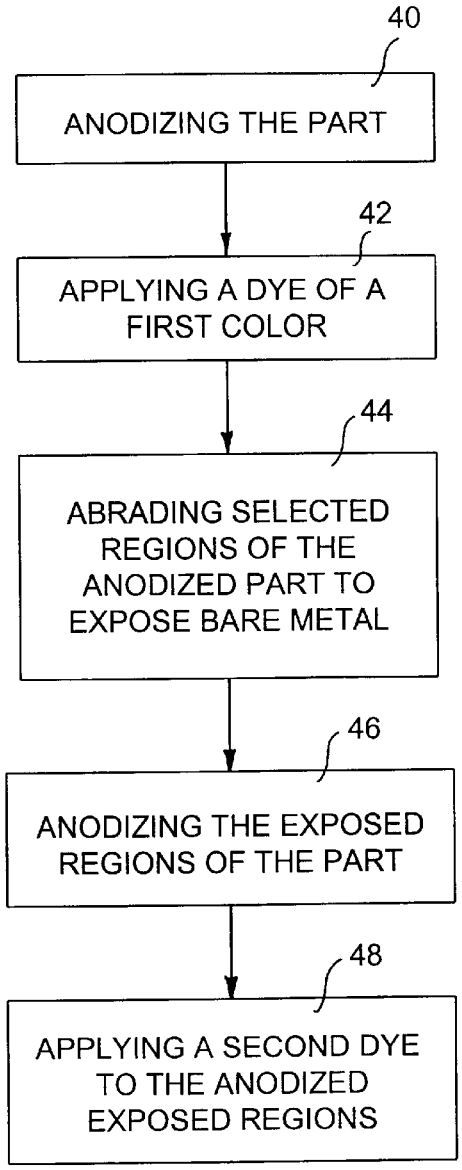
FIG. 3 is a flow chart schematic illustrating a process of creating an aluminum part having two regions of different color, according to a second embodiment of the invention.

Referring to FIG. 3, a second embodiment of the invention uses two separate anodizing steps to produce a picture frame stock having two regions of different color. The process here starts at step 40 anodizing the aluminum frame stock (or part) and then dying the anodized part at step 42 with a first color. This anodizing/dying process yields an aluminum picture frame having a single first color (the color of the absorbed dye). At step 44, selected portions of this first color anodized aluminum frame stock are abraded in a controlled manner, using for example, a conventional grinding machine, so that a specific region (or regions) of the anodized first color frame stock is removed, leaving exposed aluminum in these abraded regions. According to the invention, other methods may be used to remove the selected anodized regions in place of grinding, including the use of a sanding machine, or using sandblasting techniques. Regardless of the abrading technique used to remove the selected anodized regions, the mechanical abrading process results in a clean and sharp boundary-line 16 between the exposed aluminum and the remaining single color anodized regions. This abrading step may optionally be followed up with a conventional polishing process (which is effectively a finer abrading process).

According to this second embodiment of the invention, once the selected regions of the first color anodized frame stock have been removed (exposing the aluminum in these regions), the entire frame stock is again anodized at step 46 of FIG. 3, and dyed (preferably using a contrasting second color to the first-color used in the first anodized regions) at step 48. It is important to note that during this second anodizing procedure, the frame stock is not re-etched in an acid or alkali bath since this step would invariably remove the remaining first color anodized regions from the frame stock.

It is preferred to use a dark color first (such as black or dark blue), completing the process using a second light color (such as gold or light blue). Applicant has discovered that during the second dyeing process, the second color dye is absorbed not only into the newly anodized (previously abraded) surface (i.e., the selected abraded regions), but also into the first color dyed regions (the non-abraded regions). The absorption of the second color dye into the first color dye tends to produce a richer, denser first color than was first obtained. The resulting frame stock has a first regions 18 of a first color, a second region 20 having a second color, and a sharp boundary line 16 formed between them.

Of course, the above described processes of the invention uses only two regions of different color, the above process may be repeated to introduce a third colored region (or more) to the aluminum frame stock. Also, this process and the following ones may be equally applied to any aluminum part, not just aluminum frame stock.

Figure 4:
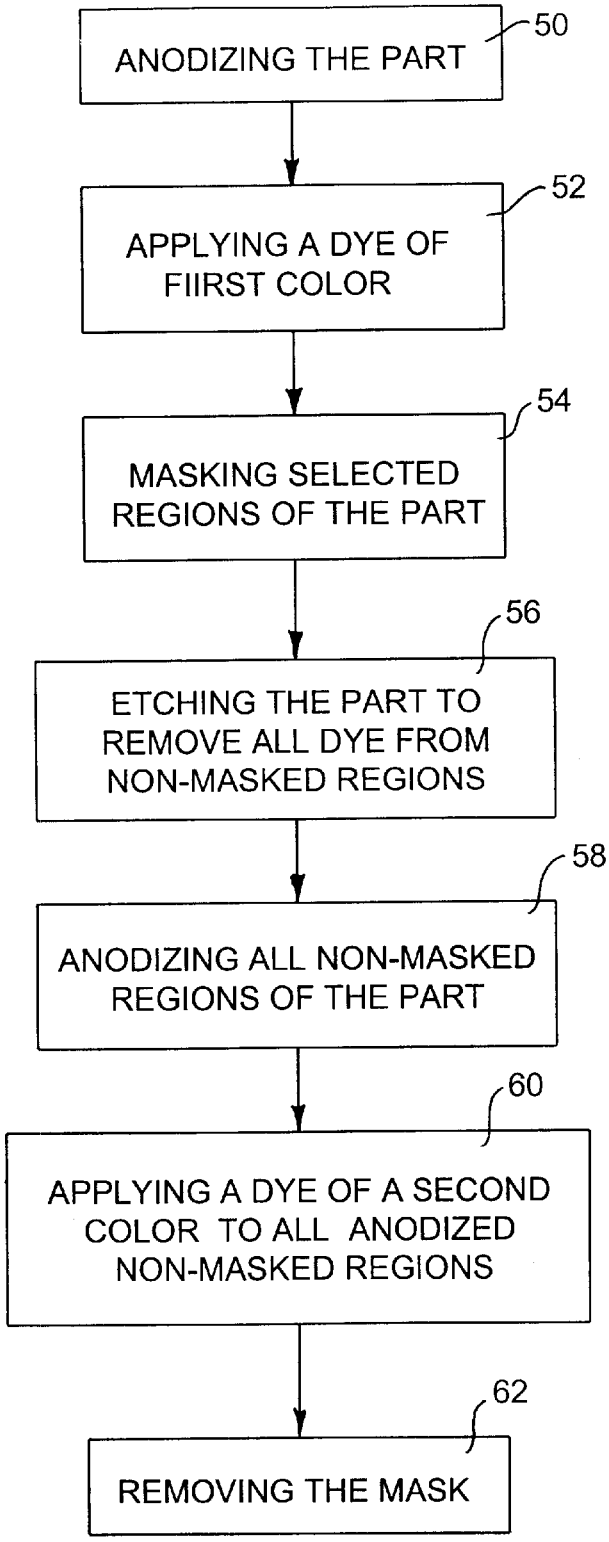
FIG. 4 is a flow chart schematic illustrating a process of creating an aluminum part having two regions of different color, according to a third embodiment of the invention.

The abrading step of the above-described process (first embodiment) may be eliminated by first masking off (protecting) selected areas of the first-color regions where the first color is to be retained as described in the following third embodiment of the invention referring to FIG. 4. According to this third embodiment of the invention, first the aluminum frame stock (or part) is anodized at step 50, and dyed a first color at step 52. The part is then masked at step 54. The particular maskant used is chosen to be resistant to the etch and anodize baths (i.e., resistant to alkaline and/or acidic solutions, depending on which is used). After the mask is applied to the frame stock using any appropriate application technique, the entire frame stock is immersed in an etching bath at step 56, which causes unmasked (and unprotected) regions of the frame stock to be stripped of the first-color, down to bare aluminum metal.

After the etching process, the entire frame stock is again anodized at step 58, and dyed with a second color at step 60. During the dyeing step, the second color dye is absorbed by the newly anodized (unmasked) regions of the frame stock only. Following this, the maskant is stripped away at step 62 using a suitable solvent, such as acetone (if a cellulose-based maskant is used) to reveal the first color regions resulting in frame stock having two regions of different color.

What is claimed is:

1. A method for applying at least two colors to an aluminum part, comprising the steps of:

coating the part with a maskant, said maskant having a first color;

mechanically removing selective regions of the first-colored maskant to expose aluminum in these regions;

anodizing the part so that the exposed regions become anodized; and applying a dye of a second color to said part so that the anodized regions of the part absorbs the second color.

2. The applying method of claim 1, wherein said maskant is a paint.

3. The applying method of claim 2, wherein said paint is cellulose based.

4. The applying method of claim 2, wherein said paint is polyester based.

5. The applying method of claim 1, wherein said mechanical removing step includes abrasion.

6. The applying method of claim 1, wherein said mechanical removing step includes scraping.

7. The applying method of claim 1, wherein said mechanical removing step includes grinding.

8. The applying method of claim 1, wherein said mechanical removing step includes sand-blasting.

9. A method for applying at least two colors to an aluminum part, comprising the steps of:

anodizing the part;

immersing the part in a dye of a first color so that the anodized surface of the part absorbs the first color;

mechanically removing selective regions of the first-colored anodized surface to expose aluminum in these regions;

anodizing the part so that the selective exposed regions of the part become anodized; and dyeing the part in a dye of a second color so that the newly anodized regions of the part absorb the second color.

10. The applying method of claim 9, wherein said mechanical removing step includes abrasion.

11. The applying method of claim 9, wherein said mechanical removing step includes scraping.

12. The applying method of claim 9, wherein said mechanical removing step includes grinding.

13. The applying method of claim 9, wherein said mechanical removing step includes sand-blasting.

14. A method for applying at least two colors to an aluminum part, comprising the steps of:

anodizing the part;

immersing the part in a dye of a first color so that the anodized surface of the part absorbs the first color;

masking selective regions of the first-colored part using a mask that is etch resistant, etching the part to remove first-color dye from all non-masked regions;

anodizing the part so that all non-masked regions become anodized;

dyeing the part in a dye of a second color so that the newly anodized regions of the part absorb the second color; and removing the mask so that both first and second colored regions of the part are exposed.

* * * * *